United States Patent [19]

Theilacker

[11] Patent Number: 4,587,899

[45] Date of Patent: May 13, 1986

[54] INKER FOR APPLYING AXIALLY PARALLEL STRIPES TO A ROTARY PRINTING MACHINE

[75] Inventor: Klaus Theilacker, Friedberg, Fed. Rep. of Germany

[73] Assignee: M.A.N.-Roland Druckmaschinen Aktiengesellschaft, Augsburg, Fed. Rep. of Germany

[21] Appl. No.: 749,940

[22] Filed: Jun. 27, 1985

[30] Foreign Application Priority Data

Jun. 28, 1984 [DE] Fed. Rep. of Germany ..... 3423735

[51] Int. Cl.[4] ..... B41F 31/02

[52] U.S. Cl. ..... 101/365; 101/DIG. 26

[58] Field of Search ..... 101/365, 367, DIG. 26, 101/348–350, 147–148, 207–208, 314–315, 329–331

[56] References Cited

U.S. PATENT DOCUMENTS

| | | | |
|---|---|---|---|
| 4,328,748 | 11/1982 | Schramm | 101/DIG. 26 |
| 4,527,477 | 7/1985 | Galster et al. | 101/365 |

FOREIGN PATENT DOCUMENTS

| | | | |
|---|---|---|---|
| 555983 | 4/1958 | Canada | 101/365 |
| 2648098 | 10/1976 | Fed. Rep. of Germany | 101/365 |
| 2723578 | 11/1978 | Fed. Rep. of Germany | 101/365 |
| 120833 | 7/1976 | German Democratic Rep. | 101/365 |
| 1437974 | 6/1976 | United Kingdom | 101/365 |
| 2083410 | 3/1982 | United Kingdom | 101/365 |

*Primary Examiner*—E. H. Eickholt

*Attorney, Agent, or Firm*—Frishauf, Holtz, Goodman & Woodward

[57] ABSTRACT

To transfer ink from an ink trough (2, 3) to an ink receiving roller (1), the ink is transferred in the form of axially adjacent rings or circumferential strips of ink. The rings or strips of ink are generated by placing two superposed plates (4, 5), each having front edges (A, B) with recesses or notches (16, 18) therein, the ink flowing through the notches. The width of the ink strips is controlled by axially shifting one of the plates (5) with respect to the other (4) by engagement of the shiftable plates with an eccenter (11–14). The transferred circumferential strips or rings are then milled in the standard milling roller arrangement of printing machine inkers.

14 Claims, 3 Drawing Figures

INKER FOR APPLYING AXIALLY PARALLEL STRIPES TO A ROTARY PRINTING MACHINE

The present invention relates to an inker for a rotary printing machine, and more particularly to the construction of an ink trough which is located adjacent an ink receiving roller, the ink receiving roller picking up ink in axially parallel strips or rings, and means to control the quantity of ink being transferred to the ink receiving roller.

BACKGROUND

There are two basic ways of controlling the quantity of ink being transferred to an ink receiving roller from an ink trough. One such way is the application of a doctor blade against the ink receiving roller, to strip off ink being picked up thereby and leave only a film thereon, the thickness of which is controlled by the setting of the doctor blade against the roller. Zone screws can be used to vary the quantity of ink being transferred in axially adjacent zones. Another way is to apply ink in rings or strips, in which the thickness of the ink film being applied is always the same, and using resilient, axially shiftable metering tongues, engaging the roller, and changing the amount of ink being transferred to the roller.

German Pat. No. 26 48 098 describes an arrangement of the first type, in which metering elements are used, resiliently engaged against the ink receiving roller. The metering elements, which can be separately controlled by zoning adjustment screws, permit metering of the ink; use of separate resilient spring-like engagement has the advantage that the thickness of ink being transferred at any one zone will be the same, regardless of centricity errors which may occur in the roller. Such metering arrangements have a disadvantage, however: If the quantity of ink required is very small, so that at least some of the zones of ink transfer have only very thin films of ink applied thereto, the metering arrangement is particularly subject to contamination with respect to fine particles, dirt, and the like, which may be transferred to the ink application roller from the ink trough. Solids, and particularly solid particles, grains, and other elements may jam between the resilient application blade and the ink receiving roller, and then, in operation, firmly adhere thereto. The quantity of ink being transferred thus becomes uncontrollable, and the uniformity, particularly of thin ink layers, is not retained. A further disadvantage is this: The respective metering elements are engaged with the rollers in an almost tangential engagement. Due to the high hydrodynamic forces, the spring force must be high, which is damaging both to the doctor blade elements as well as to the ink receiving roller if the doctor blade actually engages the surface thereof. The second type of ink transfer arrangement—see German Democratic Republic Pat. No. 120,833—transfers ink in ring-shaped strips throughout the width of the ink receiving roller, and the quantity of ink being transferred is determined by the width of the raspective strips of ink, in the respective ink zones. The thickness of these ring-shaped strips will always be the same. The ink receiving roller is then engaged with rollers of a roller train, some of which are axially oscillating, to provide for milling of the ink film on the respective rollers of the roller train, and thus render essentially uniform the ink film on the rollers of the inker roller train. The milling rollers, thus, distribute the ink so that a film of ink in zones of varying thickness will be obtained eventually by the rollers of the roller train. The metering principle of this type eliminates the danger of collection of solid particles and the like which arises in the inker of the first type described, since, even if the ink requirement is low, a sufficient distance between the metering range of any one ink zone and the ink receiving roller can be maintained. The required width of the ink film, in accordance with this disclosure, is determined by adjacently located longitudinally shiftable metering tongues which include wedge-shaped notches, thereby forming adjacently located support regions and metering regions. The metering tongues, which are elastic and tangentially engage the ink receiving rollers with their support regions, can be shifted in axial direction only with comparatively high force due to the hydrodynamic pressure arising in operation.

THE INVENTION

It is the object to improve an inker for a rotary printing machine, and more particularly to improve an inker of the type described in the aforementioned German Democratic Republic Pat. No. 120,833, which is easily controlled, permits more accurate and finer adjustment and metering of ink than previously possible, and can be operated with low control or adjustment forces.

Briefly, a plurality of ink metering elements are provided which are formed of two superposed plates, each having a resilient front edge formed with recesses or notches which at least approximately match each other. The resilient front edge engages the surface of the roller. The recesses or notches permit ink to flow to the roller and coat the roller in circular strips or rings of ink. One of the plates can be shifted axially with respect to the other, so that the relative position of the recesses or notches, in alignment or blocking relation, or in intermediate positions, can be changed, thereby controlling the width of the circular strip or ring of ink which is applied to the roller.

The system has the advantage that the rings or strips of ink, all of the uniform thickness determined by the depth of the notches or recesses, can be accurately controlled even if the ink requirement in any particular zone on the ink receiving roller is low. By use of a substantial number of notches or recesses at the front edge of the metering plates, uniform narrow or wider rings of ink can be applied, throughout the length of the zone on the ink receiving roller. Milling these rings to form a uniform coating on the rollers of an inker roller train then is a simple matter, for example by use of axially oscillating rollers. By use of comparatively narrow recesses or notches at the front edges of the ink metering plates, transition between two adjacent ink zones is hardly noticeable on the ink receiving roller, thereby providing for a uniform, yet individually controllable ink quantity, throughout the axial length of the inker rollers and a suitably controlled, essentially smoothly varying ink coating over the entire length of the ink roller can be readily generated, and reproducibly controlled.

DRAWINGS

FIG. 1 is a schematic cross section through an ink trough of a rotary printing machine with the metering arrangement in accordance with the present invention; and FIGS. 2 and 3 are views taken along section lines II—II and III—III of FIG. 1, respectively.

DETAILED DESCRIPTION

Figure 1:
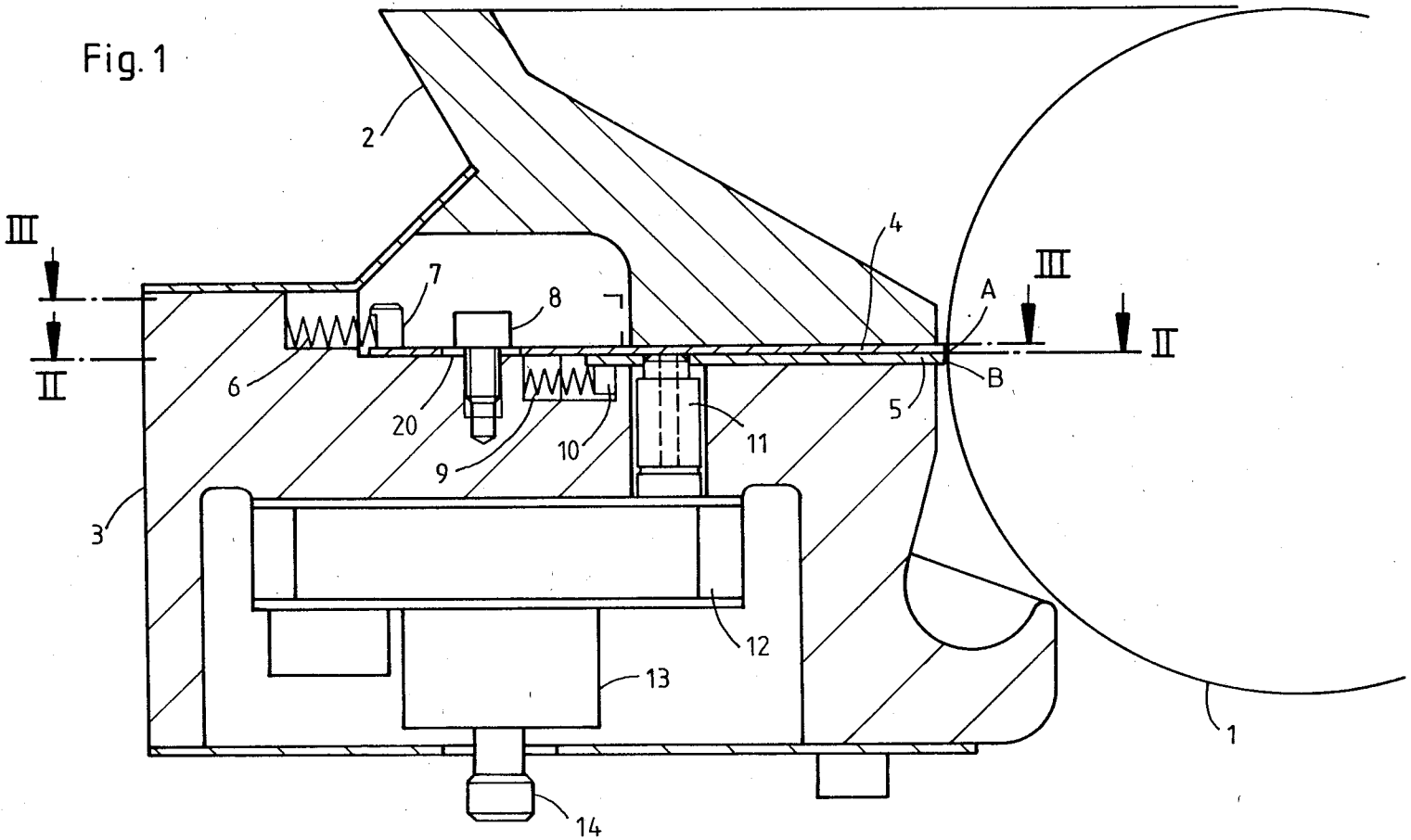

The inker shown in FIG. 1 has an inker trough 2 and an inker roller 1. Ink is to be applied on the inker roller 1 in axially extending inking zones, depending on the ink requirement of columns to be printed on the printing machine—not shown. All rollers of an inker roller train not necessary for an understanding of the present invention have been omitted and may be constructed in accordance with any suitable and well known arrangement. Some of those rollers will be axially oscillating or shifting milling rollers.

Figure 3:
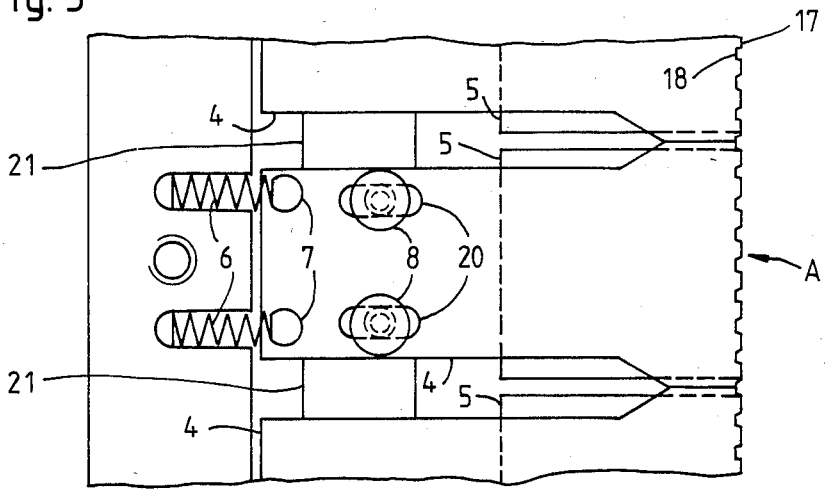

The ink applied to the inker roller 1 will be in the form of a number of parallel strips or rings of ink, the thickness of which will always be the same, but the width of which should be individually controllable. The ink received by the roller 1 is then milled—as well known—and transferred over the remaining rollers of the inker to a suitable printing cylinder. The ink trough has an upper portion 2 and a lower portion 3. In accordance with a feature of the invention, two ink metering plates 4, 5 engage with their front edges A, B. respectively, the ink receiving roller 1 in radial direction. The upper plate 4, which is radially longer than the lower plate 5, is pressed by springs 6, for example two springs (FIG. 3), with its front edge A essentially radially against the ink receiving roller 1. Springs 6 are supported with one one end in the lower ink trough portion 3, and with its other end on a bolt 7 secured to the plate 4. One or more attachment screws 8 attaches the plate 4 to the lower portion 3 of the ink trough, insuring that the plate 4 can move only radially with respect to the roller 1. The plate 4 is laterally retained by the respective screws 8. Elongated or oval holes 7 permit radial movement, while providing for longitudinal guidance.

The plate 5 is somewhat shorter, radially, than the plate 4, and its front edge B is also resiliently essentially radially engaged with the ink receiving roller 1. Two springs 9 are provided for each plate 5 which are supported with one end in the lower ink trough portion 3 and, with the other end, on support bolts 10 secured to the respective plates 5—see FIG. 2.

Figure 2:
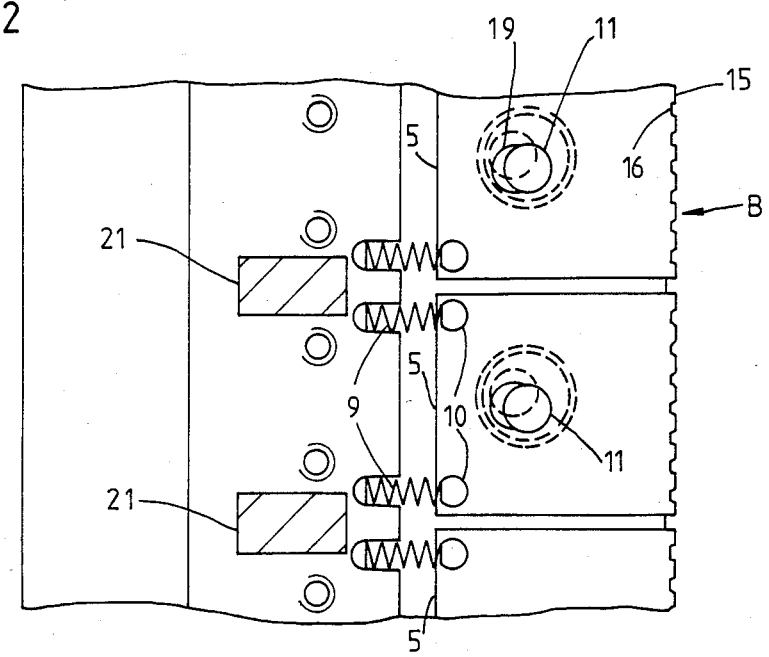

As best seen in FIG. 2, each of the plates 5 has an elongated or oval-shaped hole 19 therein, which is engaged by an eccenter 11. The eccenter 11 is adjusted by means of a gearing 12 which can be positioned by a positioning motor 13. The positioning motor 13, preferably, has a projecting shaft with a manually adjustable button 14 thereon, so that the position of the eccenter 11 can be changed either automatically, by the motor 13, or manually, by rotating the rotor thereof, and hence the reduction gearing 12. By rotating the gearing 12 manually or automatically, the eccenter, engaging the elongated hole, will shift the lower plate 5 in axial direction with respect to the ink receiving roller 1. The front edge B of the lower plate 5 remains in resilient engagement with the ink receiving roller 1.

The front edges A, B of the plates 4, 5 are formed with recesses or notches 18, 16, respectively. The depth of the notches is the same, and the shape of the notches and the protrusions, therebetween, will be the same—in other words, the front edges A, B of the plates 4, 5 will, at least approximately, match. A large number of ink rings or strips, per unit length, or per ink zone, can be applied to the circumference of the ink-receiving roller 1, depending on the number of recesses or notches 16, 18, so that subsequent milling of the ink film is simple. There will be practically no radically changing transition zones, that means, regions without ink between adjacent metering elements. The notches 16, 18 are so controlled that they can, respectively, cover each other or leave the entire width free. It is not necessary that the notches 16, 18 are located in alignment over each other. The plates 4, 5 may, but need not have the same width. The plate 4, for example, may have a width which, looked at in axial direction, corresponds to a multiple of an ink zone width.

The plates 4, being guided in the elongated holes 20 and between guide elements 21 (FIG. 3), for example formed by guide blocks secured to one of the ink trough portions 2 or 3, are restrained from axial movement, with respect to the ink receiving roller 1. The lower plates 5 may be shifted axially, however, by the eccenters 11. Thus, due to the comb-like recesses 16, 18 in the superimposed plates 5, 4, the front edges A, B will define recesses or notches of effectively different widths—looked at in axial direction; the depth of the notches, however, will remain uniform. Individual control of the respective ink zone, and hence of the quantity of ink, thus is readily possible by controlling the width of the effective notches through which ink can pass to the ink receiving roller.

In operation, the plates 4, 5 can be positioned so that they will be in alignment, so that the support portions 15 of the plate 5 and the support portions 17 of the plate 4 will be aligned; likewise, the notches 16 of plate 5 and the notches 18 of plate 4 will be in alignment. The throughput—looked at in axial direction with respect to the ink receiving roller 1—will be a maximum. Ink rings of maximum width will be transferred to the ink receiving roller in the individual ink zone where this alignment position is controlled. Upon relative shifting of the plates 4, 5 in axial direction, a support zone 17 of the plate 4 will cover partly or entirely the notch or recess 16 of the plate 5 therebelow, corresponding to less or no ink requirement in the respective ink zone. Essentially no ink may pass, that is, no ring of ink will be transferred to the ink receiving roller. By use of the eccenter, electrically or manually controlled, the lower plates 5 will be shifted relative to the upper plate 4 in axial direction; very fine adjustment between ink blocking, ink passing, and intermediate positions can be obtained so that the quantity of ink can be accurately controlled and metered between minimum and maximum positions and any intermediate value. The width of the rings of ink being transferred thus can be accurately controlled, while the thickness will remain uniform and hence problems in connection with contamination of ink in the ink trough are effectively avoided.

Various changes and modifications may be made within the scope of the inventive concept.

For example, the axial width of the fixed plate 4 may correspond either to the axial width of the shiftable plate 5, or may be a whole number multiple thereof. The shape of the notches 16, 18 can be suitably selected and, preferably, is essentially rectangular—see FIGS. 2 and 3.

I claim:

1. Inker for a rotary printing machine having
an ink trough (2);
an ink receiving roller (1) positioned to receive ink from the ink trough;
and a plurality of ink metering elements located axially adjacent each other and positionable against the ink receiving roller (1) to control ink flow from the trough to the surface of the roller, wherein, in accordance with the invention, the ink metering elements comprise two superposed plates (4, 5), each having a resilient front edge (A, B) formed with at least approximately matching recesses or notches (18, 16), said resilient front edges (A, B) engaging the surface of the ink receiving roller (1) so that, at the location of the recesses or notches, ink will be permitted to flow to the roller (1) and coat the roller in circular strips or rings of ink; and means (11, 12, 13, 14) for axially shifting one plate (5) with respect to the other (4) to thereby change the relative position of the recesses or notches of said plates with respect to each other, and thereby control the width of the circular strips or rings of ink being applied to the roller.

2. Inker according to claim 1, wherein the means for axially shifting one of the plates with respect to the other comprises a reduction gearing (12) and an eccenter (11) driven by the reduction gearing, and an elongated opening (15) formed in said one plate, and engaged by the eccenter (11).

3. Inker according to claim 1, wherein a plurality of recesses or notches (16, 18) are formed at the front edges (A, B) of each of the plates (4, 5).

4. Inker according to claim 3, wherein the notches are of essentially rectangular configuration.

5. Inker according to claim 1, wherein said recesses or notches are of essentially rectangular configuration.

6. Inker according to claim 1, wherein one (4) of the plates (4,5) is axially secured to the ink trough (2, 3) and the axially shiftable plate (5) is located beneath said one (4) of the plates.

7. Inker according to claim 1, wherein the radial dimensions of the plates (4, 5) are different;

and individual spring means (6, 9) are provided, engaging the respective plates and pressing the respective plates, essentially radially, against the ink roller (1).

8. Inker according to claim 1, wherein the axial width of said one plate (5) is axially shiftable corresponds to the width of an ink zone division;

and the axial width of the other plate (4) has at least approximately the same width dimension as said one plate.

9. Inker according to claim 1 , wherein the axial width of said one plate which is axially shiftable corresponds to the width of an ink zone division;

and the axial width of the other plate (4) has at least approximately the width of a whole number multiple of the width of said axially shiftable plate.

10. Inker according to claim 1, wherein said plates engage the roller (1) in at least approximately radial direction.

11. Inker according to claim 3, wherein said plates engage the roller (1) in at least approximately radial direction.

12. Inker according to claim 6, wherein said plates engage the roller (1) in at least approximately radial direction.

13. Inker according to claim 7, wherein said plates engage the roller (1) in at least approximately radial direction.

14. In combination with a printing machine, the inker of claim 1, wherein the recesses or notches (16, 18) of one of the plates (4) are positioned in the machine non-congruent with the recesses or notches of the other of the plates.

* * * * *